US005847471A

United States Patent [19]

Morishita et al.

[11] Patent Number: 5,847,471

[45] Date of Patent: Dec. 8, 1998

[54] STARTER HAVING PLURALITY OF MOUNTING ANGLES

[75] Inventors: Akira Morishita; Keisaku Zenmei; Shuzo Isozumi, all of Himeji, Japan

[73] Assignee: Mitsubishi Denki Kabushiki Kaisha, Tokyo, Japan

[21] Appl. No.: 840,549

[22] Filed: Apr. 3, 1997

Related U.S. Application Data

[63] Continuation of Ser. No. 425,739, Apr. 20, 1995, abandoned.

[30] Foreign Application Priority Data

Apr. 28, 1994 [JP] Japan ..... 6-092106

[51] Int. Cl.[6] ..... F02N 15/06

[52] U.S. Cl. ..... 290/48; 290/38 A; 74/6; 74/7 R

[58] Field of Search ..... 290/38 R, 38 A, 290/38 B, 38 C, 46, 47, 48; 74/6, 7 R, 7 A

[56] References Cited

U.S. PATENT DOCUMENTS

| | | | |
|---|---|---|---|
| 2,523,928 | 9/1950 | Szekely | 285/330 |
| 2,765,133 | 10/1956 | Antonidis | 248/645 |
| 3,395,594 | 8/1968 | Blair | 74/606 R |
| 3,787,014 | 1/1974 | Story et al. | 248/558 |
| 4,362,065 | 12/1982 | Baratti | 74/7 A |
| 4,553,442 | 11/1985 | Mazzorana | 74/7 A |
| 4,601,378 | 7/1986 | Pierce et al. | 192/115 |
| 4,918,324 | 4/1990 | Isozumi | 290/48 |
| 4,953,414 | 9/1990 | Ueno et al. | 74/6 |
| 5,048,355 | 9/1991 | Ueno | 74/7 A |
| 5,163,335 | 11/1992 | Isom et al. | 74/6 |
| 5,220,844 | 6/1993 | Mills | 74/6 |

FOREIGN PATENT DOCUMENTS

| | | |
|---|---|---|
| 2625770 | 7/1989 | France . |
| 41 27 742 A1 | 2/1993 | Germany . |
| 42 23 209 A1 | 2/1993 | Germany . |
| 2 259 116 A | 3/1993 | United Kingdom . |

*Primary Examiner*—Thomas M. Dougherty
*Assistant Examiner*—Nicholas Ponomarenko
*Attorney, Agent, or Firm*—Sughrue, Mion, Zinn, Macpeak & Seas, PLLC

[57] ABSTRACT

A starter in which a flange member is mounted to the starter body in accordance with the mounting conditions of the engine. An output shaft is disposed coaxially with the rotating shaft of the motor, and a front housing of the overhang type is used. Changing the mounting angle does not change the position of the motor, so that by simply replacing the flange member, a common front housing can be used to allow mounting in accordance with a larger number of mounting conditions. In addition, the tabular shape of the flange member allows die costs to be reduced.

10 Claims, 13 Drawing Sheets

STARTER HAVING PLURALITY OF MOUNTING ANGLES

This is a continuation of application Ser. No. 08/425,739, filed on Apr. 20, 1995, now abandoned.

BACKGROUND OF THE INVENTION

1. Field of the Invention

This invention relates to an engine starter, which is, for example, installed in an automobile or a ship engine, to start the engine.

2. Description of the Related Art

In general, conditions for mounting a starter on an engine, namely, the distance between a mounting surface and a ring gear, the angle and pitch of mounting holes, and ring gear specifications, differ according to the type of engine used so that each different engine type requires a housing to be provided on the starter side which fulfils the mounting conditions for that particular engine. In addition, a new die is required to manufacture the housing.

Large diesel engines, for example, are made in many models because of their various uses, but not many of each model are manufactured. In mounting starters to such multimodel small-quantity production type engines, it would be costly to manufacture a special-purpose die every time a starter is to be mounted to a different model engine, so adjustable types in which the base part is common and only the part which fulfils the mounting conditions of the starter has a special shape are utilized.

FIG. 15 is a partial cross sectional view of a conventional starter. Referring to FIG. 15, a motor 1 is connected to an output shaft 3 through a gear section 2 which constitutes an internal reduction mechanism. An overrunning clutch 4 and a pinion 5 capable of reciprocating motion on the output shaft 3 such that it engages a ring gear (not illustrated) of the engine are provided.

The overrunning clutch 4 is connected to a magnetic switch section 7 by means of a lever 6. The lever 6 is connected to the one end of a plunger 8 provided at the magnetic switch section 7. A movable contact 10, which is brought into contact with and separated from a fixed contact 9, is provided at the other end of the plunger 8. The plunger 8 is held by a reset spring 11 such that the movable contact 10 is separated from the fixed contact 9.

The magnetic switch section 7 is fixed to a base housing 12, with the lever 6 housed within this base housing 12. A front nose type adjustable housing 13 which constitutes the portion which allows mounting of the starter in accordance with the mounting conditions, is fixed to the base housing 12. The output shaft 3, the overrunning clutch 4, the pinion 5, etc., are housed in this adjustable housing 13. An opening 13*a* is formed in the adjustable housing 13, so as to allow the pinion 5 to engage the ring gear.

Description will now be made of the operation of the starter. Applying current to a coil of the magnetic switch section 7 causes the plunger 8 to be attracted in opposition to the reset spring 11 and to move toward the left in the figure. This causes the movable contact 10 to come into contact with the fixed contact 9, which allows current flow through the motor 1. The movement of the plunger 8 rotates the lever 6, which causes the overrunning clutch 4 and the pinion 5 to move toward the right in the figure along the output shaft 3. As a result of this, the pinion 5 engages the ring gear of the engine.

With the rotation of the motor 1 transmitted to the pinion 5 through the gear section 2, the-output shaft 3, and the overrunning clutch 4, the engine is started. Upon start-up of the engine, when current flow to the coil of the magnetic switch section 7 is blocked, the plunger 8 is moved toward the right in the figure by the restoring force of the reset spring 11 to separate contacts 9 and 10. The overrunning clutch 4 is moved back to its original position by means of the lever 6, which is accompanied by the pinion 5 separating from the ring gear.

Conventional starters of this type are disclosed, for example, in Japanese Patent Laid-Open No. 1-182574, Japanese Utility Model Publication No. 56-23493, and U.S. Pat. No. 4918324.

In conventional starters with the above-described construction, the output shaft 3 and the rotating shaft of the motor 1 are offset. Therefore, if the mounting angle is changed through the adjustable mounting, the motor 1 is moved such that it describes an arc, which results in interference with the engine auxiliary equipment. This gives rise to the problem that the mounting angle can be varied only within a very limited range.

The position of the opening 13*a*, which is formed in a front nose type adjustable housing 13, is determined with respect to the position of the mounting holes used for mounting the starter to the engine. Therefore, when an adjustable-type is used, the range within which the mounting angle can be changed is again limited. In addition, since in the adjustable housing 13, a flange section with mounting holes, which determines the mounting angle, is made integral with the nose section having the opening 13*a*, the die structure for making this housing 13 becomes complicated. In addition, the die of the adjustable housing 13 as well as that of the base housing 12 become very expensive.

SUMMARY OF THE INVENTION

Accordingly, an object of the present invention is to provide a starter which is capable of being mounted to a larger number of mounting conditions and which can be cast with a die low in cost.

In order to achieve the above object, there is provided a starter comprising a starter body including a motor, an output shaft disposed coaxially with a rotating shaft of the motor, a planetary reduction mechanism transmitting rotation of the motor to the output shaft, a pinion provided such that it is capable of reciprocating movement in the axial dimension of the output shaft and engaging a ring gear of an engine, an overrunning clutch transmitting rotation of the output shaft to the pinion, a contact separating means for separating the pinion from the ring gear, and an overhang type metallic front housing housing at least the output shaft and the overrunning clutch of the aforementioned component parts, and a metallic flange member, having mounting sections for mounting to the engine and the front housing respectively, the flange member being mounted to the starter body in accordance with the mounting conditions of the engine.

DESCRIPTION OF THE PREFERRED EMBODIMENTS

A description will be made below of the embodiments of the invention.

First Embodiment

Figure 1:
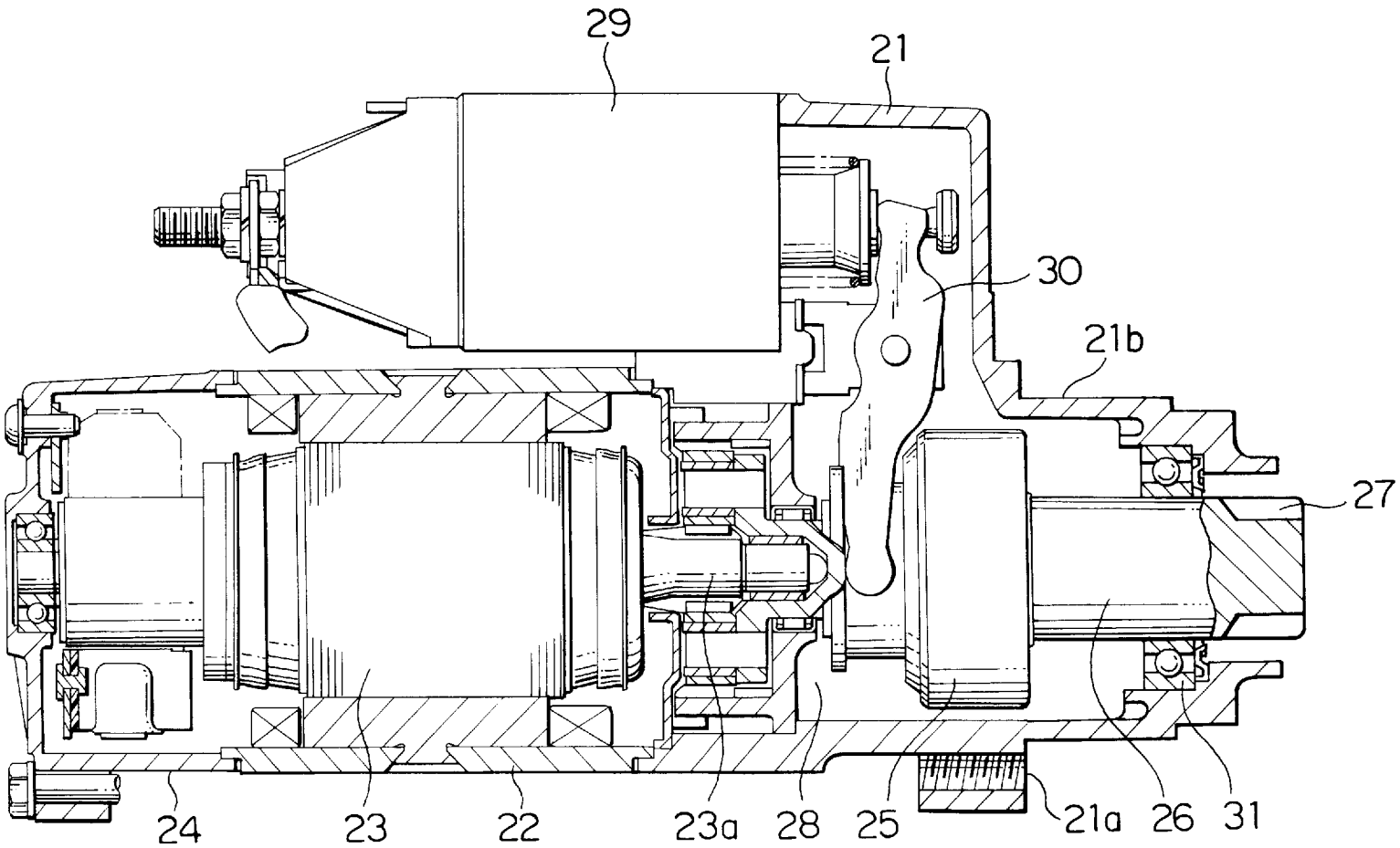
FIG. 1 is a partial sectional view of a body of a starter as a first embodiment of the invention.
Figure 2:
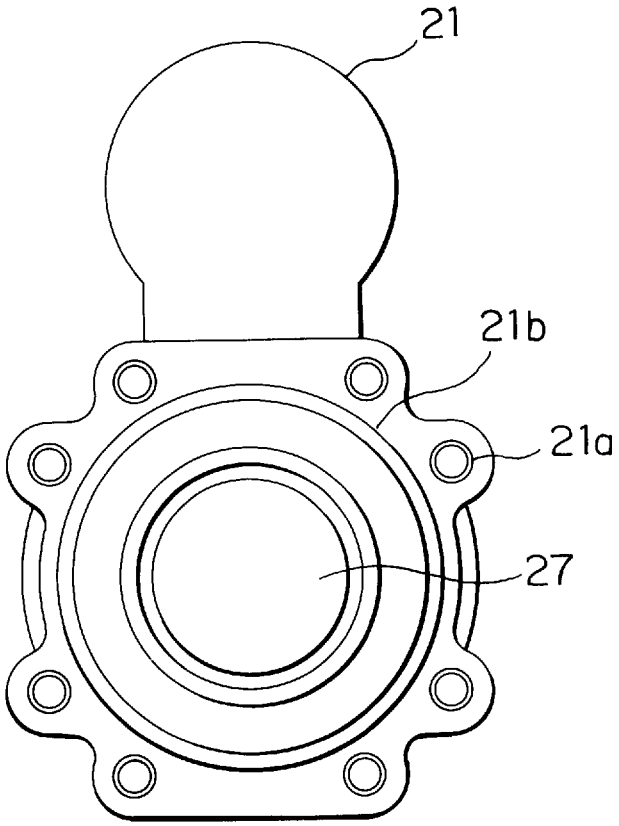
FIG. 2 is a front view of the starter body of FIG. 1.

FIG. 1 is a partial sectional view of a body of a starter as a first embodiment of the invention. FIG. 2 is a front view of the starter body of FIG. 1. Referring to FIGS. 1 and 2, a plurality of threaded holes 21*a* are formed in the outer periphery of an overhang type front housing 21. A yoke 22 is fixed to this overhang type front housing 21, within which yoke 22 is provided a motor 23. A rear housing 24 is fixed to the rear end (or left end portion in the figure) of the yoke 22.

An overrunning clutch 25 is housed within the front housing 21. A pinion 27, engaging an engine ring gear (not illustrated), is formed at the end portion of a pinion moving body 26, integral with a clutch inner of the overrunning clutch 25. The pinion moving body 26 is capable of movement reciprocating in the axial dimension. An output shaft (not illustrated) is provided within the overrunning clutch 25. The driving power of motor 23 is transmitted to the pinion 27 through a planetary reduction mechanism 28, the output shaft, and the overrunning clutch 25. The output shaft, the overrunning clutch and the pinion 27 are disposed coaxially with a rotating shaft 23*a* of the motor 23.

A magnetic switch section 29 is fixed to the front housing 21. The magnetic switch section 29 engages with a lever 30 which is rotatably housed in front the housing 21 to move the pinion 27 along with the pinion moving body 26 in the axial dimension through this lever 30. The magnetic switch section 29 and the lever 30 form a contact separating means. A bearing 31, which slidably contacts and supports the outer periphery of the pinion moving body 26, is fitted to a spigot joint 21*b* of the front housing 21.

Figure 3:
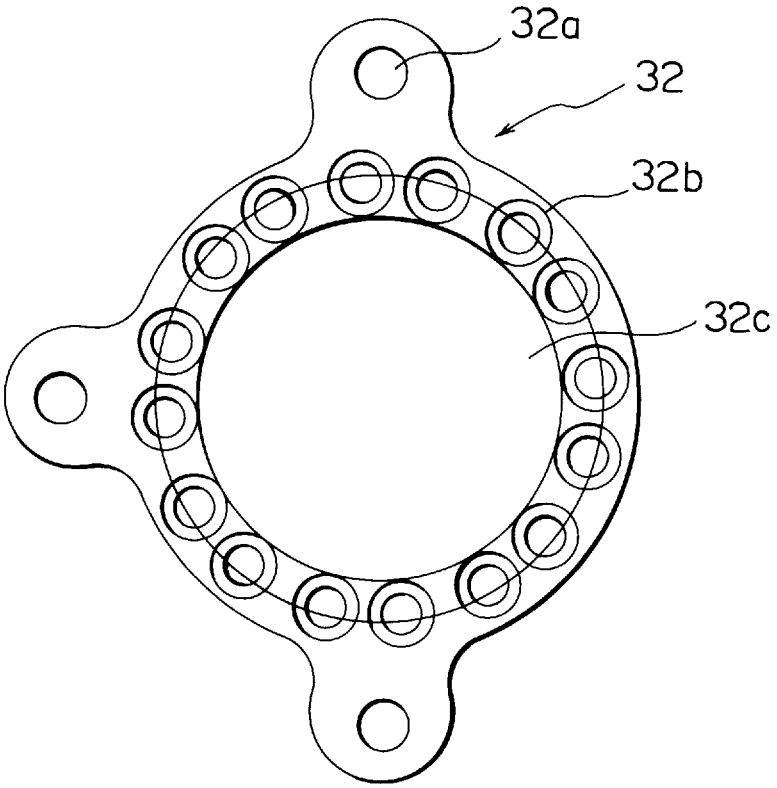
FIG. 3 is a front view of a flange member in the first embodiment of the invention.
Figure 4:
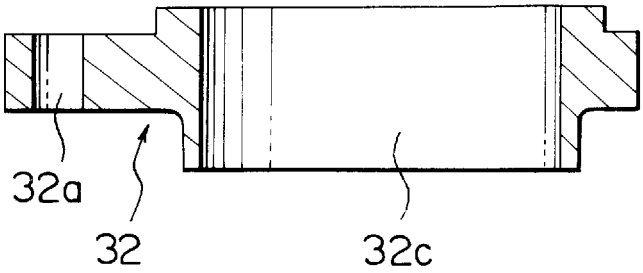
FIG. 4 is a cross sectional view of FIG. 3.

Such a starter body with the above-described structure is mounted to the engine through a flange member 32 such as those shown, for example, in FIGS. 3 and 4. A plurality of engine mounting holes 32*a*, serving as mounting sections to the engine, and a plurality of housing mounting holes 32*b*, serving as mounting sections to front housing 21, are formed in flange member 32. Although the housing mounting holes 32*b* are not illustrated in FIG. 4, they are formed on the same circumference, so that mounting angles with the front housing 21 can be changed. A through hole 32*c* is formed in the center of the flange member 32 for completely inserting the spigot joint 21*b* of the front housing 21.

The front housing 21, the rear housing 24, and the flange member 32 are each made of metal such as, for example, die-cast aluminum.

Figure 5:
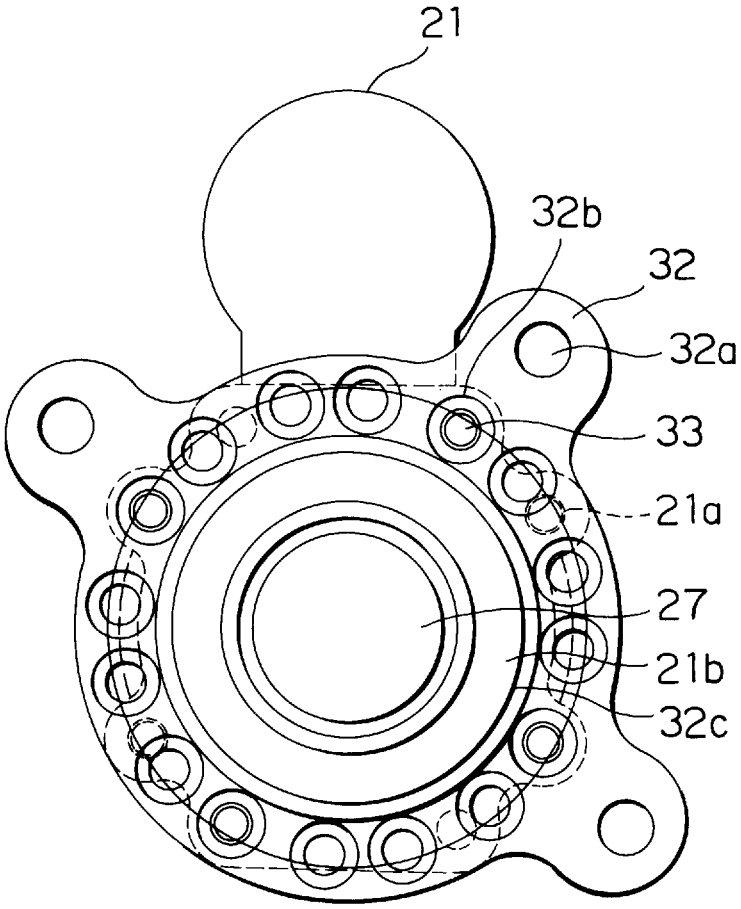
FIG. 5 is a front view illustrating the flange member mounted to the starter body of FIG. 1.
Figure 6:
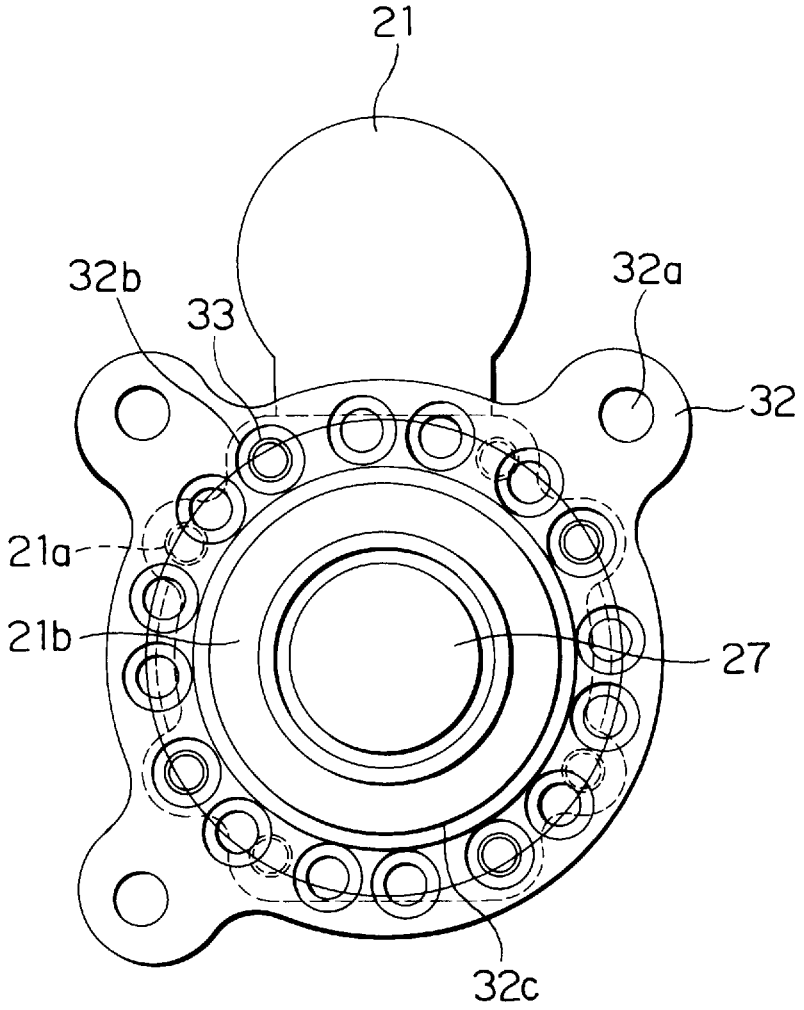
FIG. 6 is a front view illustrating the flange member mounted to the starter body at an angle different from that in FIG. 5.
Figure 7:
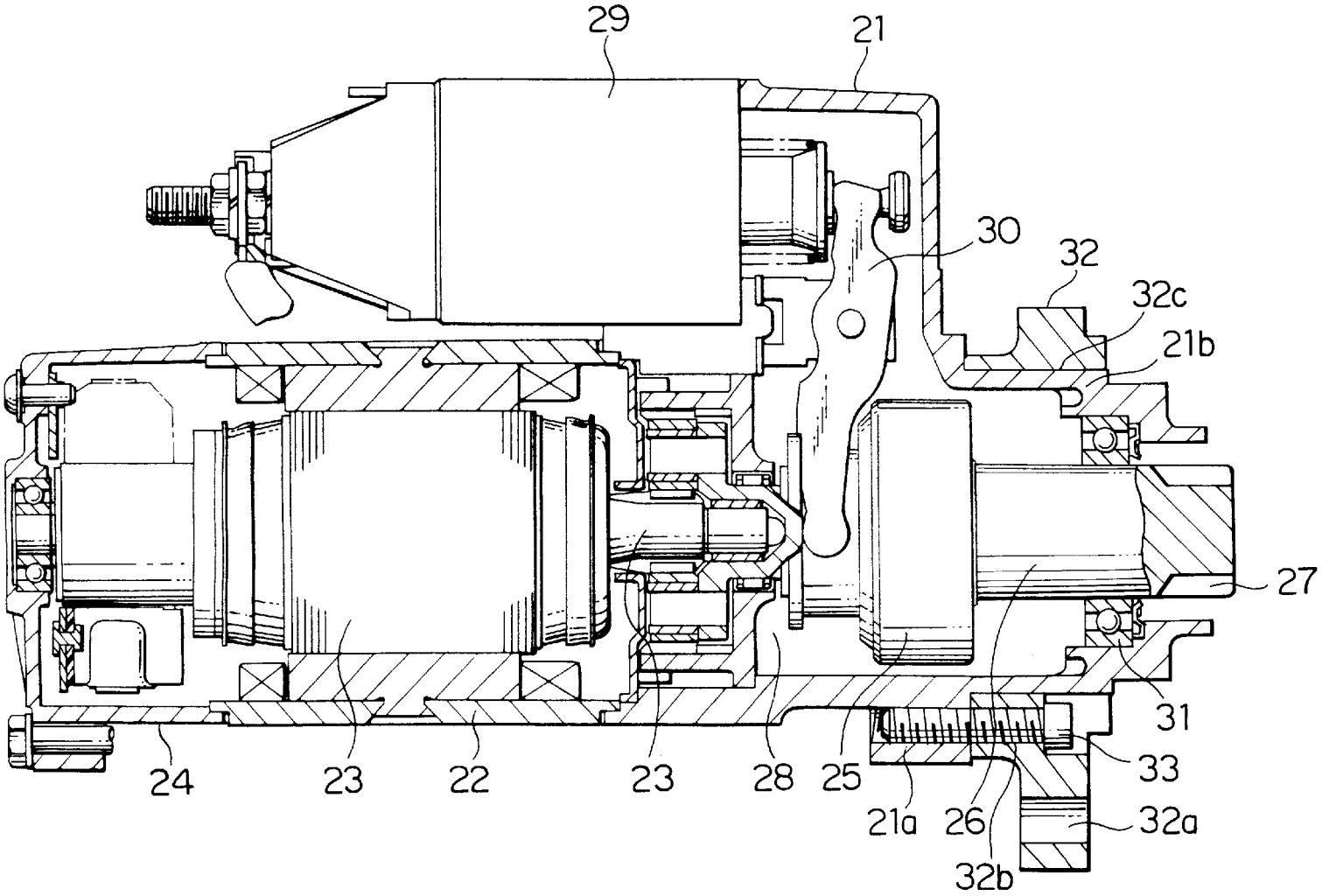
FIG. 7 is a partial cross sectional view of the starter, with the flange member mounted to its body in FIG. 5 or FIG. 6.

FIGS. 5 and 6 are front views each illustrating flange member 32 of FIG. 3 fixed to the starter body of FIG. 1, while FIG. 7 is a partial cross sectional view of the flange member 32 of FIG. 3 fixed to the starter body of FIG. 1 as in FIG. 5 or FIG. 6. The housing mounting holes 32*b* are selected such that the mounting angle allows mounting in accordance with the mounting conditions to the engine. Thereafter, the flange member 32 is placed upon threaded holes 21*a* in the front housing 21, and are secured with screws 33.

In such a starter, the mounting angle to the engine can be adjusted by selecting the appropriate housing mounting holes 32*b* in the flange member 32. The position where the pinion 27 comes to rest after the starter has been mounted to the engine can be adjusted by changing the dimension or the thickness of the flange member 32 in the axial dimension. In addition, since the rotating shaft 23*a* of the motor 23 and the output shaft are coaxially disposed, changing the mounting angle does not change the position of the motor 23. Further, since the housing is an overhang type housing, it is not necessary to form an opening section in the front housing 21 as in conventional housings.

Therefore, by merely changing the flange member 32, the common front housing 21 can be used to allow mounting in accordance with a larger number of mounting conditions. In addition, since the flange member 32 may be tabular in shape, the structure of the die becomes relatively simple, thereby reducing costs.

Second Embodiment

Figure 8:
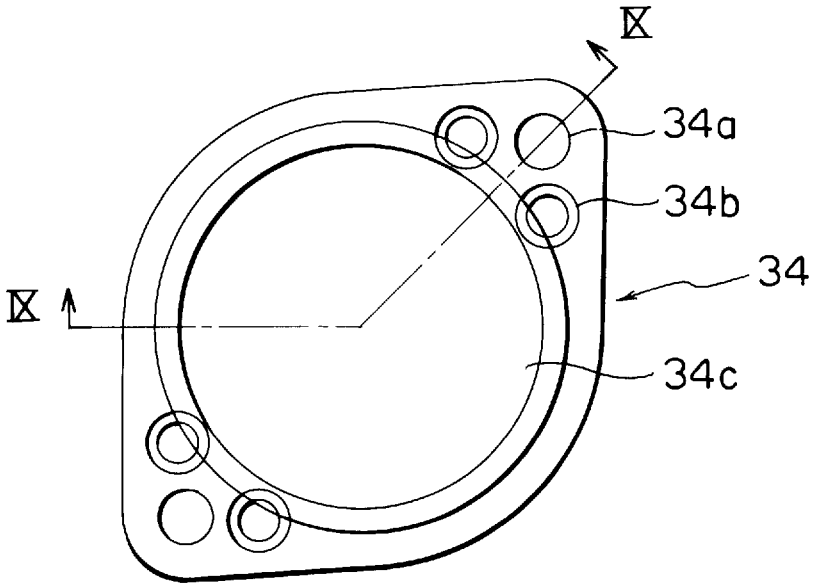
FIG. 8 is a front view of a flange member in a second embodiment of the invention.
Figure 9:
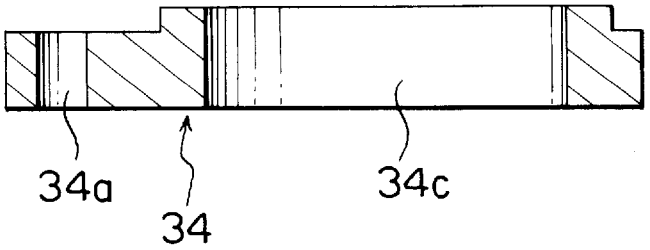
FIG. 9 is a cross sectional view in the direction of the arrows taken along line IX—IX of FIG. 8.
Figure 10:
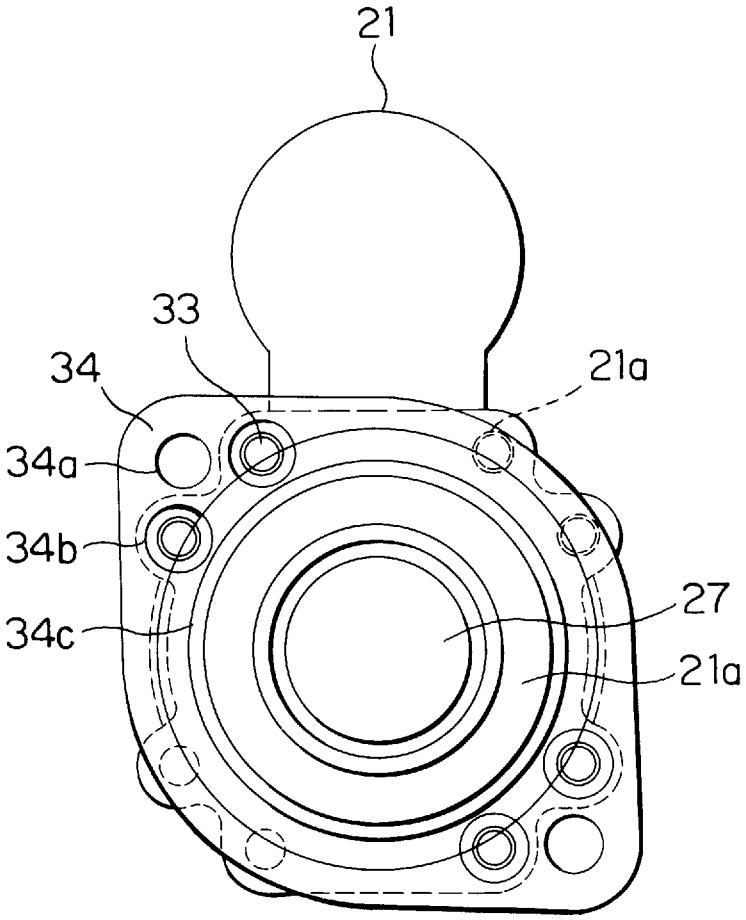
FIG. 10 is a front view of the flange member of FIG. 8 mounted to the starter body of FIG. 1.
Figure 11:
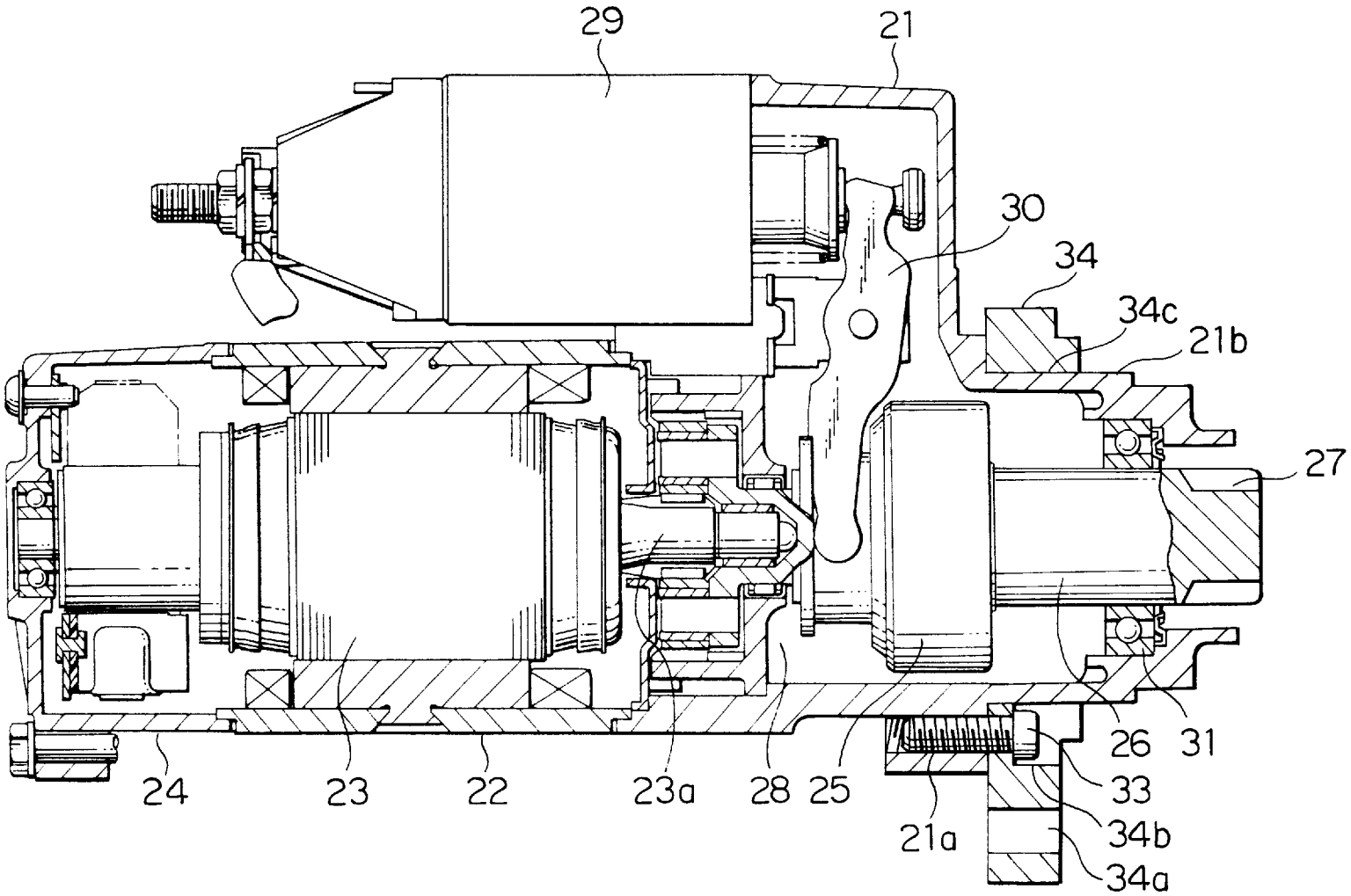
FIG. 11 is a partial cross sectional view of FIG. 10.

The flange member may be modified in various ways depending on the mounting conditions to the engine and the type of the starter body. FIGS. 8 and 9 each show a modification thereof. Referring to the figures, engine mounting holes 34*a*, housing mounting holes 34*b*, and a through hole 34*c*, are formed in flange member 34. FIGS. 10 and 11 each illustrate the flange members of FIGS. 8 and 9 mounted to the starter body of FIG. 1.

Third Embodiment

Figure 12:
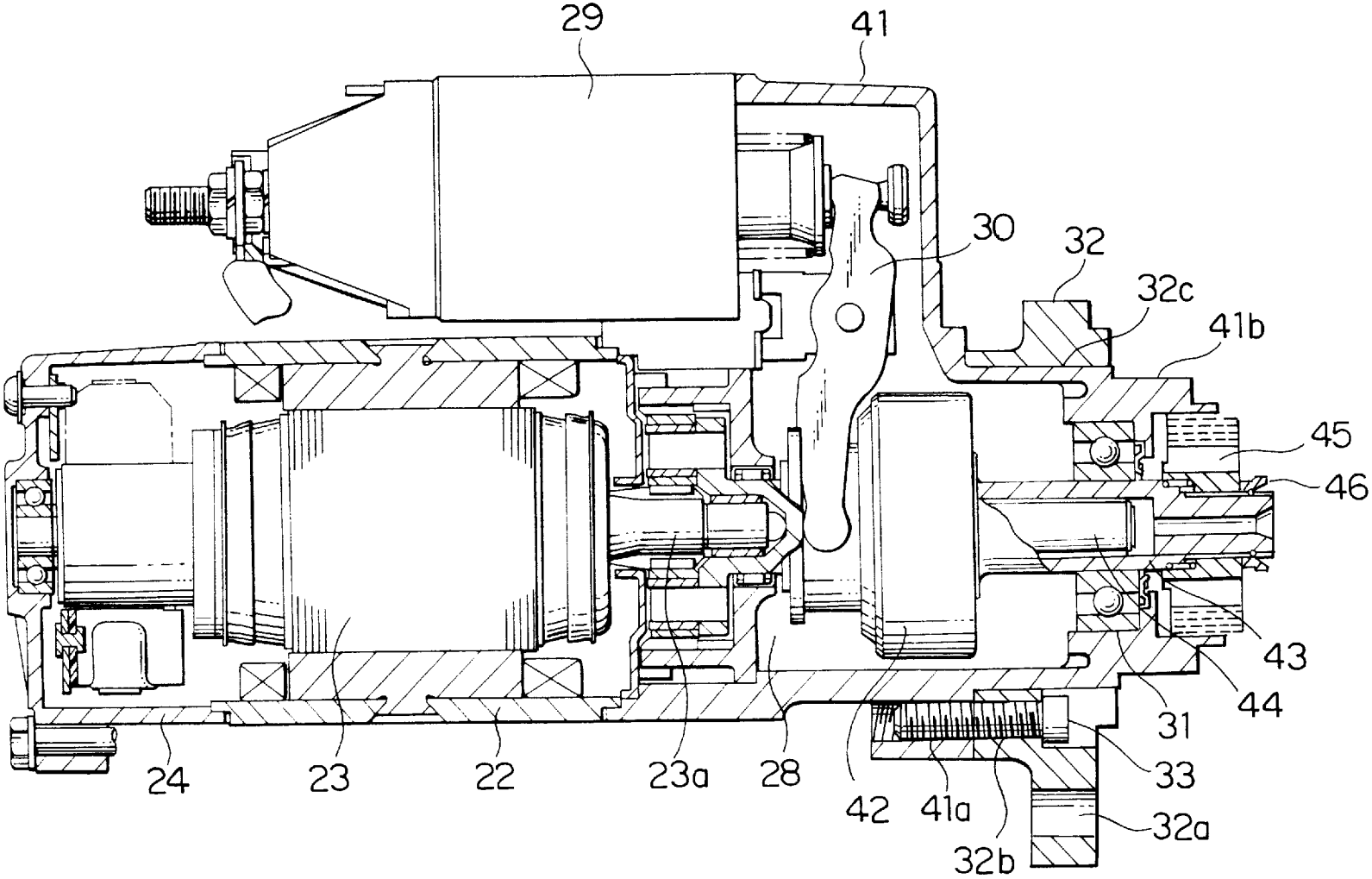
FIG. 12 is a partial cross sectional view of a starter as a third embodiment of the invention.

FIG. 12 is a partial cross sectional view of a starter as a third embodiment of the invention. Referring to FIG. 12, a plurality of threaded holes 41*a* are formed in the outer peripheral section of a front housing 41, made, for example, of die-cast aluminum, which serves as a base. The flange member 32 is fitted into a spigot joint 41*b* of the front housing 41 and secured thereto by the screws 33, as in the first embodiment. As in the first embodiment, the flange member 32 which is capable of allowing mounting in accordance with the mounting conditions of the engine is selected. In addition, the front housing 41 is fixed at a mounting angle in accordance with the mounting conditions. An overrunning clutch 42 is housed in the front housing 41. An output shaft 44 which transmits driving power of the motor 23 to a pinion moving body 43 is inserted through the pinion moving body 43 integral with the clutch inner of the overrunning clutch 42. The pinion moving body 43 is slidably in contact and supported by the bearing 31.

A pinion 45 selected in accordance with the ring gear specification is adjustably fixed to a portion located forward of the bearing 31 supporting the pinion moving body 43. The pinion 45 and the pinion moving body 43 are separate parts and the pinion 45 is fitted to the pinion moving body 43 such that it rotates with the pinion moving body 43. The pinion 45 is fixed in the axial dimension by a stopper 46, which allows it to reciprocate in the axial dimension with the pinion moving body 43.

In the starter of the third embodiment, the pinion 45 and the pinion moving body 43 are formed as separate parts, so that it is possible to mount the pinion 45 with a shape, number of teeth, and teeth size in accordance with the engine ring gear specification. Therefore, the common front housing 41 and the pinion moving body 43 may be used to further increase the number of conditions in accordance with which the starter can be mounted to the engine.

Fourth Embodiment

Figure 13:
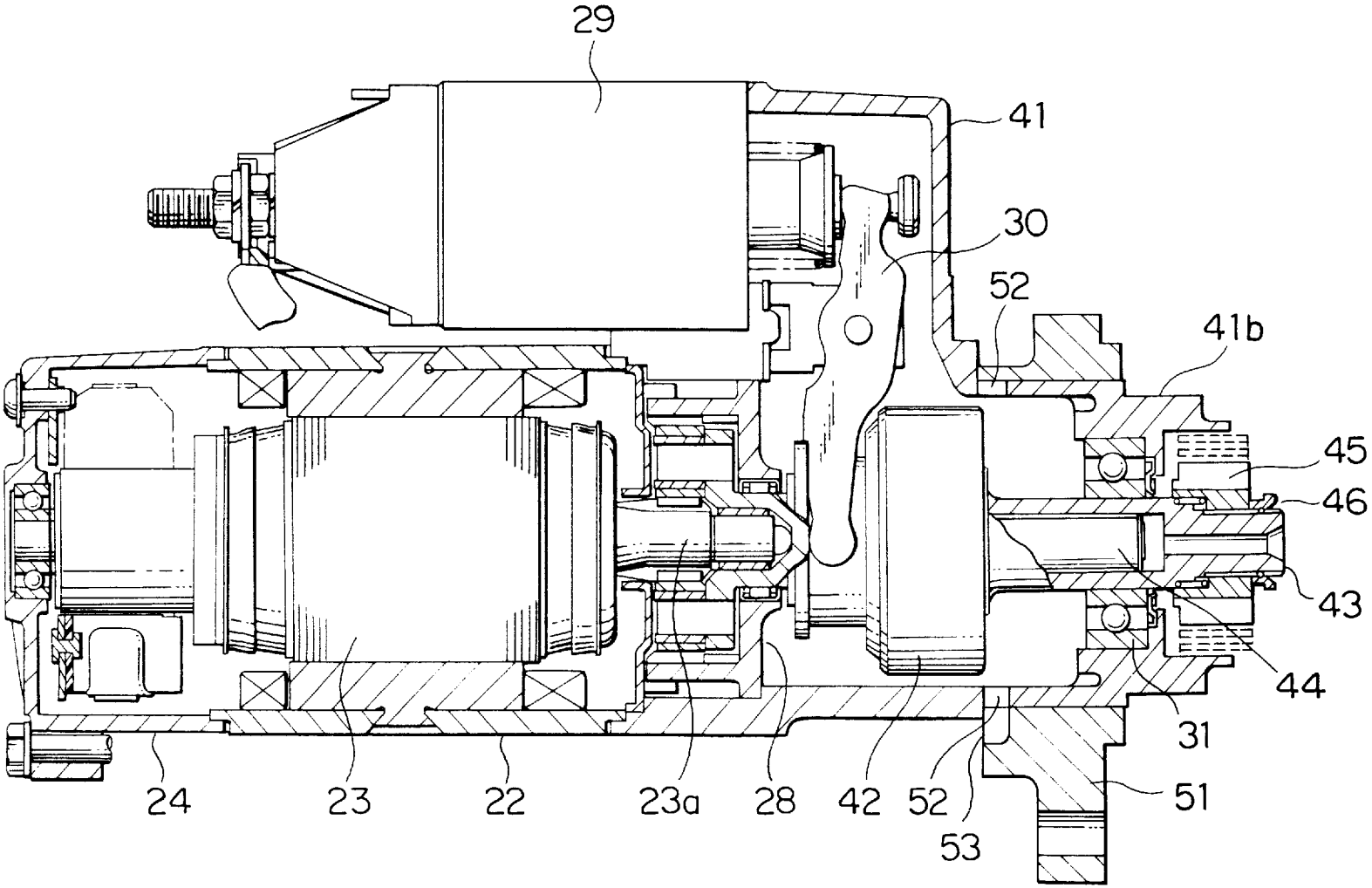
FIG. 13 is a partial cross sectional view of a starter as a fourth embodiment of the invention.
Figure 14:
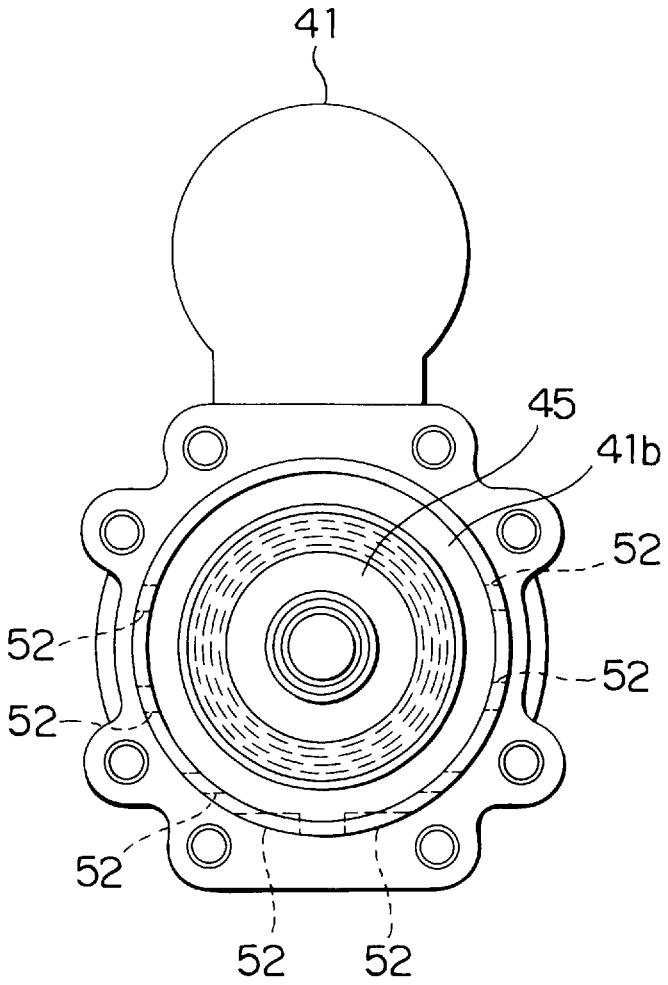
FIG. 14 is a front view of the starter body of FIG. 13.
Figure 15:
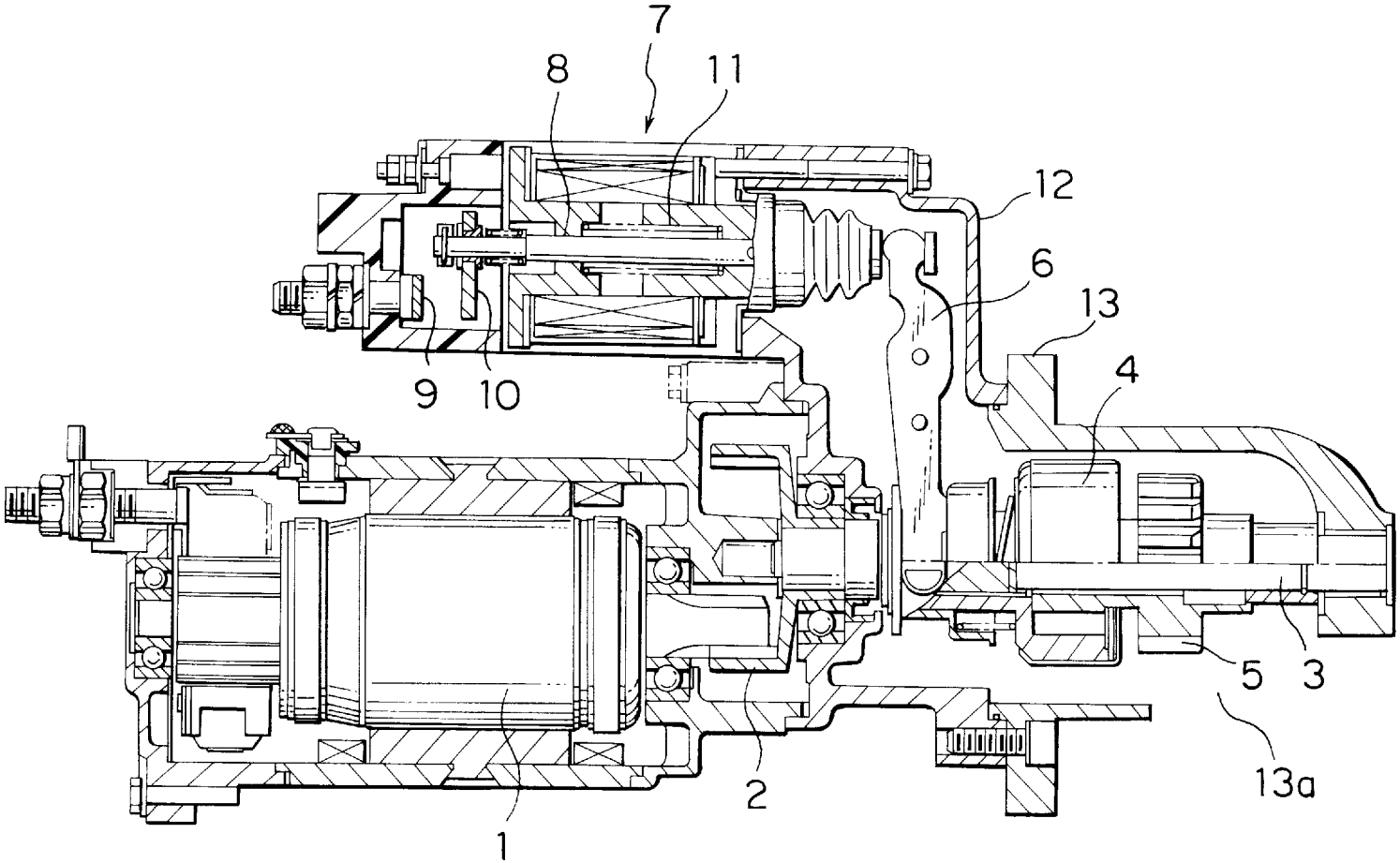
FIG. 15 PRIOR ART
FIG. 15 is a partial cross sectional view of a conventional starter.

FIG. 13 is a partial cross sectional view of a starter as a fourth embodiment of the invention. FIG. 14 is a front view of the starter body of FIG. 13. Referring to FIGS. 13 and 14, a flange member 51 is fitted into spigot joint 41*b* of the front housing 41 made, for example, of die-cast aluminum and fixed by screws (not illustrated). As in the first embodiment, a suitable flange member 51 which allows mounting in accordance with the mounting conditions is selected, with the front housing 41 secured at a mounting angle in accordance with the mounting conditions.

A plurality of through holes 52 are formed in a portion where the flange member 51 of the front housing 41 is mounted. These through holes 52 are disposed at equal distances from one another in the peripheral dimension. A drain hole 53, which communicates with the through hole 52 disposed at the ground side or the position nearest to the ground while the flange member 51 is mounted to the engine, is provided in the flange member 51. The other through holes 52 are covered by the inner peripheral face of the flange member 51.

In such a starter, even if water flows into the front housing 41, it can flow out from the through hole 52 nearest the ground side and the drain hole 53, which prevents the parts in the front housing 41 from being damaged. In addition, since the other through holes 52 are covered by the flange member 51, water will not enter therefrom to cause water exposure, and water can easily flow out with the common front housing 41 even when the mounting angle has been changed.

What is claimed is:

1. A starter mounting system having a plurality of starter mounting angles for configurably engaging a starter with a selected one of a variety of engines which have respective ring gears, said starter configurably engaging a first ring gear of a first engine at a first mounting angle, and configurably engaging a second ring car of a second engine at a second mounting angle, said first mounting angle being different from said second mounting angle, said first and said second engine each having respective engine holes for mounting said starter, said starter mounting system comprising:

a starter body including:

a motor, an output shaft disposed coaxially with a rotating shaft of said motor, a planetary reduction mechanism transmitting rotation of said motor to said output shaft, a pinion provided such that it is capable of reciprocating movement in the axial dimension of said output shaft and engaging said respective ring gear, an overrunning clutch transmitting rotation of said output shaft to said pinion, a contact separating means for separating said pinion from said ring gear, an overhang type metallic front housing housing at least said output shaft and said overrunning clutch of the aforementioned component parts, said front housing having a plurality of front housing holes at an outer periphery thereof and a spigot joint, and a bearing, fitted inside said spigot joint of said front housing and slidably contacting and supporting an outer peripheral portion of a pinion moving body which is integral with a clutch inner of said overrunning clutch; and a plurality of selectable metallic flange members, each flange member having a central hole for said spigot joint, a respective thickness, an engine mounting section for mounting to said engine at said engine holes, and a front housing mounting section for mounting to said front housing at said front housing holes respectively, said front housing mounting section of said each flange member having a plurality of flange member holes greater in number than said plurality of front housing holes;

wherein when said selected one of said variety of said engines is said first engine, said engine mounting section of said each flange member of said starter mounts to said first engine at said engine holes thereof, said front housing mounts to said front housing mounting section of said each flange member such that ones of said plurality of front housing holes align with ones of said plurality of flange member holes in a first mounting arrangement, and said first mounting arrangement causes said starter to have said first mounting angle;

wherein when said selected one of said variety of said engines is said second engine, said engine mounting section of said each flange member of said starter mounts to said second engine at said engine holes thereof, said front housing mounts to said front housing mounting section of said each flange member such that ones of said plurality of front housing holes align with ones of said plurality of flange member holes in a second mounting arrangement, and said second mounting arrangement causes said starter to have said second mounting angle; and wherein one of said plurality of selectable metallic flange members is selected so that said respective thickness of said selected flange member determines a distance between said pinion and a mounting surface of said selected one of said variety of engines.

2. A starter mounting system according to claim 1, wherein said contact separating means comprises a magnetic switch section and a lever rotatably provided between said magnetic switch section and said overrunning clutch.

3. A starter mounting system according to claim 1, wherein said front housing and said selected flange member are made of die-cast aluminum.

4. A starter mounting system according to claim 1, wherein:

a plurality of through holes is formed in said spigot joint of said front housing, said selected flange member comprises a drain hole which communicates with a lowest one of said through holes which is disposed nearest to the ground when mounted to said selected one of said variety of said engines, and said plurality of through holes, except for said lowest one, are covered by said selected flange member.

5. A starter mounting system according to claim 1, wherein said pinion is a separate part selected in accordance with a specification of said respective ring gear and is mounted to a portion forward of said bearing of said pinion moving body.

6. A starter for an engine which has a ring gear and which has engine holes in a mounting surface thereof, said starter comprising:

a motor, a rotating motor shaft, an output shaft disposed coaxially with said rotating motor shaft, a planetary reduction mechanism transmitting rotation of said motor to said output shaft, a pinion for reciprocatingly engaging said ring gear, an overrunning clutch transmitting rotation of said output shaft to said pinion and having a clutch inner integral with a pinion moving body, and means for separating said pinion from said ring gear;

an overhang type metallic front housing that has a spigot joint and that houses said output shaft, said overrunning clutch, and an outer bearing that is disposed inside said spigot joint and slidably supports said pinion moving body, said front housing having a plurality of front housing holes at an outer periphery thereof; and a metallic flange member which has a central hole through which part of said spigot joint extends, an engine mounting section for mounting to said engine at said engine holes, and a front housing mounting section for mounting to said front housing at said front housing holes, said front housing mounting section having a plurality of flange member holes greater in number than said plurality of front housing holes, said metallic flange member having a thickness that determines a distance between said pinion and said mounting surface of said engine.

7. The starter according to claim 6, wherein said means for separating comprises a magnetic switch section and a rotatable lever rotatably operably disposed between said magnetic switch section and said overrunning clutch.

8. The starter according to claim 6, wherein said front housing and said flange member comprise die-cast aluminum.

9. The starter according to claim 6, wherein:

said spigot joint comprises through holes, a lowest one of which is nearest the ground when said starter is mounted to said engine;

said flange member comprises a drain hole which communicates with said lowest one of said through holes, and said through holes, except for said lowest one, are covered by said flange member.

10. The starter according to claim 6, wherein said pinion is not integral with said pinion moving body, and is selected in accordance with a specification of said ring gear.

* * * * *